US005787975A

United States Patent [19]

Grenier et al.

[11] Patent Number: 5,787,975

[45] Date of Patent: Aug. 4, 1998

[54] HEAT EXCHANGER WITH BRAZED PLATES

[75] Inventors: Maurice Grenier, Paris; Francis Cabre, Saint Maur des Fosses; Francois Dehaine, Villemomble; Marc Wagner, Saint Maur des Fosses, all of France

[73] Assignee: L'Air Liquide, Societe Anonyme pour l'Etude et l'Exploitation des Procedes Georges Claude, Paris Cedex, France

[21] Appl. No.: 854,693

[22] Filed: May 12, 1997

Related U.S. Application Data

[62] Division of Ser. No. 396,742, Mar. 1, 1995, abandoned.

[30] Foreign Application Priority Data

Apr. 15, 1994 [FR] France ..... 94 04550

[51] Int. Cl.[6] ..... F28F 3/08

[52] U.S. Cl. ..... 165/166; 62/903

[58] Field of Search ..... 165/166, 167; 62/903

[56] References Cited

U.S. PATENT DOCUMENTS

| | | | |
|---|---|---|---|
| 3,266,568 | 8/1966 | Butt et al. . | |
| 3,559,722 | 2/1971 | Schauls et al. . | |
| 3,735,793 | 5/1973 | Burberry et al. . | |
| 3,792,842 | 2/1974 | Nakako et al. | 165/166 X |
| 3,880,231 | 4/1975 | Gauthier . | |
| 3,983,191 | 9/1976 | Schauls . | |
| 3,992,168 | 11/1976 | Toyama et al. . | |
| 4,006,776 | 2/1977 | Pfouts et al. . | |
| 4,249,595 | 2/1981 | Butt . | |
| 4,646,822 | 3/1987 | Voggenreiter et al. | 165/166 |
| 5,144,809 | 9/1992 | Chevalier et al. | 165/166 |
| 5,333,683 | 8/1994 | Arriulou et al. . | |

FOREIGN PATENT DOCUMENTS

| | | |
|---|---|---|
| 1537628 | 7/1968 | France . |
| 1121575 | 10/1984 | U.S.S.R. . |
| 2 127 140 | 4/1984 | United Kingdom . |

*Primary Examiner*—Leonard R. Leo
*Attorney, Agent, or Firm*—Young & Thompson

[57] ABSTRACT

The heat exchanger is of the type comprising a stack of parallel plates and, between these plates, undulant spacers, each pair of plates defining a passage for fluid of generally flat shape. Certain passages (20) are subdivided over one part of their length into two closed subpassages (at 45, 57) at locations longitudinally offset relative to each other. The exchanger is applicable in cryogenic heat exchangers of installations for the distillation of air.

1 Claim, 3 Drawing Sheets

HEAT EXCHANGER WITH BRAZED PLATES

This application is a division of application Ser. No. 08/396,742, filed Mar. 1, 1995, abandoned.

The heat exchanger is of the type comprising a stack of parallel plates and, between these plates, undulant spacers, each pair of plates defining a passage for fluid of generally flat shape.

Certain passages (20) are subdivided over one part of their length into two closed subpassages (at 45, 47) at locations longitudinally offset relative to each other.

Use in cryogenic heat exchangers of installations for the distillation of air.

FIELD OF THE INVENTION

The present invention relates to heat exchangers with brazed plates and with essentially longitudinal circulation of fluids, of the type comprising a stack of parallel plates and, between these plates, undulant spacers, each pair of plates defining a fluid passage of generally flat shape. They are applicable in particular to cryogenic heat exchangers used in installations for the distillation of air.

BACKGROUND OF THE INVENTION

When during an industrial process using a heat exchanger with brazed plates, it is necessary to cause a fluid to circulate over only a portion of the length of the exchanger, and when it is necessary that the process does not involve the circulation of another fluid over the complementary temperature range of the exchanger, one is confronted with the following choice: either one accepts that the complementary portion of the length of the corresponding passages constitutes a thermally inactive space in the exchanger, which decreases the overall performance, or one circulates in this spacer another fluid, which one returns to a smaller flow section within the range of temperatures affected by the fluid. This second solution is more satisfactory from the thermal point of view, but in the present art, it involves a substantial complication of the structure of the exchanger, with particularly the addition of numerous lateral boxes for the inlet/outlet of fluids.

The invention has for its object to permit choosing the second solution above, but with less cost.

SUMMARY OF THE INVENTION

To this end, according to a first embodiment, the invention has for its object a heat exchanger with brazed plates and with substantially longitudinal circulation of fluids, of the recited type, characterized in that at least one first passage is closed at a first location intermediate the length of the exchanger and, just beside this location, communicates directly with at least a second passage.

The second passage can be closed at a second position intermediate the length of the exchanger, situated beyond said first intermediate location relative to the point of communication between the first and second passages, the first and second passages communicating then also between themselves just beyond this second intermediate position.

In a first modification, said first and second passages are contiguous and communicate with each other via a series of openings.

In a second modification, on the contrary, said first and second passages are separated by a third passage serving for the circulation of another fluid and communicating between themselves via a series of tubes which pass through this third passage.

According to a second embodiment of the invention, the heat exchanger with brazed plates and with essentially longitudinal circulation of fluids, of the type indicated above, is characterized in that at least one passage is subdivided in its thickness, between two intermediate locations of its length, into two subpassages separated by an intermediate plate, a first subpassage being closed at said first intermediate position and opening freely in said passage at said second intermediate position, while the second subpassage is closed at said second intermediate position and opens freely into said passage at said first intermediate position.

According to a third embodiment of the invention, the heat exchanger with brazed plates and with essentially longitudinal circulation of fluids, of the type mentioned above, is characterized in that at least one passage is subdivided along its length into two subpassages of which one is closed at a first intermediate position along the length of the exchanger.

In this case, the other subpassage can be closed at a second intermediate position of the length of the exchanger, offset relative to the first intermediate position, such that said passage comprises in an intermediate region of its length a separation wall of generally S shape.

BRIEF DESCRIPTION OF THE DRAWINGS

Examples of embodiment of the invention will be described with respect to the accompanying drawings, in which.

DETAILED DESCRIPTION OF THE PREFERRED EMBODIMENT

Figure 1:
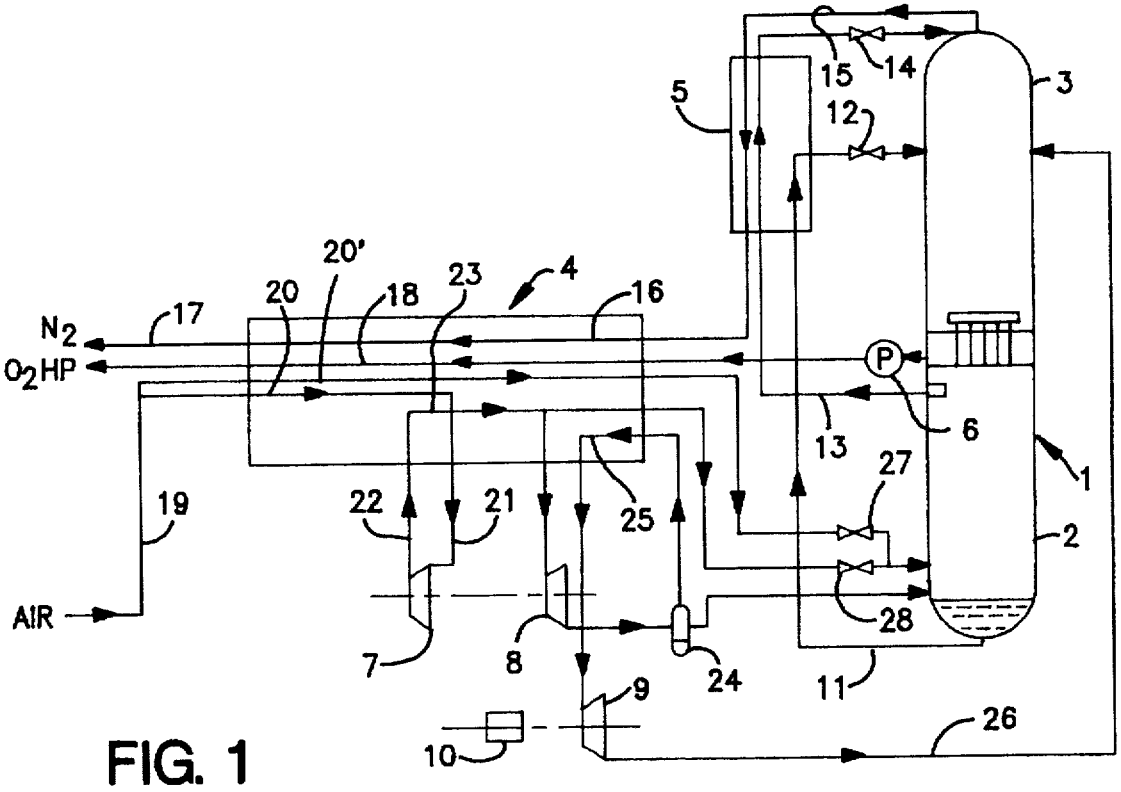
FIG. 1 represents schematically an air distillation installation to which the invention is applicable.

The installation shown in FIG. 1 is basically that described in FR-A-2 688 052, FIG. 1. This installation is adapted to produce gaseous oxygen under elevated pressure, for example of the order of 40 bars. It comprises essentially a double distillation column 1 constituted by a medium pressure column 2, operating under about 6 bars absolute, surmounted by a low pressure column 3, operating under a pressure slightly greater than 1 bar absolute, a heat exchange line 4, a subcooler 5, a liquid oxygen pump 6, a cold blower 7, a first turbine 8 whose rotor is mounted on the same shaft as that of the cold blower, and a second turbine 9 braked by a suitable brake 10 such as an alternator.

The heat exchange line 4 is constituted by a single heat exchanger of the brazed plate type.

As is well known, a heat exchanger with brazed plates is constituted by a stack of parallel plates, generally rectangular and all identical, which define two by two a multitude of flat passages. The dimensions of the plates can be great; for example, for a heat exchanger of an installation for the distillation of air, they can have a length of up to about 6 m for a width of about 1.40 m. On the other hand, the thickness of the passages is very small, typically of the order of 5 to 10 mm. The number of passages can be of the order of 120 to 150.

The mutual spacing of the plates is ensured by undulant separators which also play the role of thermal fins. These corrugations can be constituted by perforated corrugated metal sheet or with cutouts on their sides (so-called "serrated" corrugations), and have a cross section of square, rectangular, sinusoidal corrugations, etc.

The passages are hermetically closed over all their periphery by longitudinal and transverse bars, all of the same thickness equal to the height of the corrugations, except limited regions opening outwardly. These regions form series of inlet/outlet windows for fluids, vertically aligned, and each series of windows is capped hermetically by an inlet/outlet box for fluid, typically semi-cylindrical, provided with a conduit for the introduction or withdrawal of fluid. The windows associated with a given box involve of course only a certain number of passages, reserved for the corresponding fluid. For fluids circulating from one end to the other, in the longitudinal direction, of the exchanger, the boxes are adjacent the two ends of this latter, and there are provided supplemental boxes along the exchanger, in this example for the inlet/outlet of fluids at intermediate temperatures.

The plates, the corrugations and the closure bars are typically of aluminum or aluminum alloy and are assembled in sealed relationship in a single operation, by brazing in a furnace. The inlet/outlet boxes are then connected by welding. Except as indicated later on in connection with FIG. 5, each passage has the same thickness over all its extent.

There will be seen from the drawing the conventional conduits of the double column, namely: a conduit 11 rising to an intermediate point in the column 3, after subcooling in 5 and expansion to the low pressure in an expansion valve 12, of the "rich liquid" (air enriched in oxygen) collecting in the base of the column 2; a conduit 13 for raising to the head of the column 3, after subcooling in 5 and expansion to the low pressure in an expansion valve 14, of "poor liquid" (fairly pure nitrogen) withdrawn from the head of the column 2; and a conduit 15 for production of impure nitrogen, constituting the residual gas of the installation, this conduit passing through the subcooler 5 then connecting to passages 16 for reheating nitrogen in the heat exchange line 4. The impure nitrogen thus reheated to ambient temperature is removed from the installation via a conduit 17.

The pump 6 takes in liquid oxygen at about 1 bar absolute from the base of the column 3, brings it to the desired production pressure and introduces it into the oxygen vaporization-reheating passages 18 of the heat exchange line.

Air to be distilled arrives under a pressure typically of 12 to 17 bars absolute via a conduit 19 and enters two series of passages 20, 20' for cooling air in the heat exchange line.

At an intermediate temperature T1 less than ambient temperature and adjacent the temperature TV of vaporization of the oxygen (or of pseudo-vaporization if the production pressure of the oxygen is supercritical), a portion of this air, namely that carried by the passages 20, is removed from the heat exchange line by a conduit 21 and brought to the intake of the cold blower 7. This latter brings this air to a pressure of 19 to 25 bars absolute and, via a conduit 22, the air thus compressed is returned to the heat exchange line, at a temperature T2 greater than T1, and continues cooling in the supercharged air passages 23 of this latter. A portion of the air conveyed by the passages 23 is again withdrawn from the heat exchange line at a second intermediate temperature T3 less than T1, and expanded to the medium pressure (5 to 6 bars absolute) in the turbine 8. The air which leaves this turbine passes into a phase separator 24, then is sent in part to the bottom of the column 2. A portion of the vapor phase from the separator 24 is partially reheated, to an intermediate temperature T4 lower than T3, in passages 25 of the cold portion of the heat exchange line, then expanded to the low pressure in the turbine 9 and introduced at an intermediate point into the column 3 via a conduit 26.

Air conveyed by conduit 20' continues its cooling to the cold end of the heat exchange line, being liquefied and then subcooled. It is then expanded to the medium pressure in an expansion valve 27 and introduced several plates above the bottom of the column 2. Similarly, air conveyed by the passages 23 and not turbo-expanded is cooled to the cold end of the heat exchange line, then expanded to the medium pressure in an expansion valve 28 and introduced several plates above the bottom of the column 2.

Thus, the compression of at least a portion of the entering air, from the intermediate temperature T1, which is adjacent the liquefaction stage of the oxygen, to the temperature T2, introduces into the heat exchange line, between these two temperatures, a quantity of heat which substantially compensates the cold excess produced by this vaporization. It will be noted that between T2 and T1, the oxygen exchanges heat with all the air at 12 to 17 bars and with the air supercharged to 19 to 25 bars. There can thus be obtained a heat exchange diagram (enthalpy on the ordinate, temperature on the abscissa) which is very favorable, with a small temperature difference of the order of 2° to 3° C., at the warm end of the heat exchange line.

The blower 7 which ensures this compression is driven by the turbine 8, such that no external energy is needed. Given the mechanical losses, the quantity of cold produced by this turbine is slightly greater than the heat of compression, and the excess contributes to maintaining the installation cold. The necessary thermal balance for this cold maintenance is supplied by the turbine 9.

It will be seen that, in the embodiment of FIG. 1, the problem of circulation of a fluid over only a fraction of the length of the exchanger arises twice: on the one hand, for the passages 23 for supercharged air, between the two intermediate positions along the length of the exchanger 4 which correspond respectively to the temperatures T2 and T1, and on the other hand for the passages 25 for reheating medium pressure air, which extend only from the cold end of the exchanger to the intermediate position along its length which corresponds to the temperature T4.

Let us first consider the passages 23 in connection with FIGS. 2–7.

Figure 2:
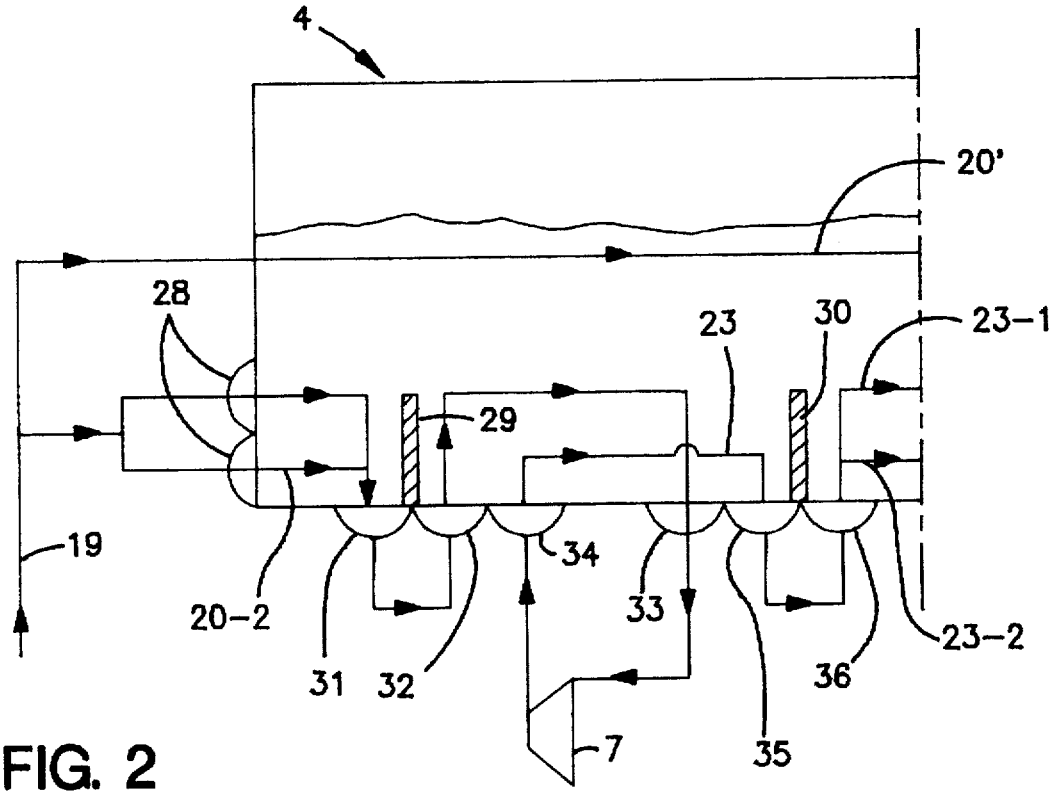
FIG. 2 shows schematically a portion of the principal heat exchanger of this installation, according to conventional construction.

To avoid the presence of thermally inactive spaces in the exchanger due to the existence of the passages 23 between the temperatures T2 and T1, one is lead, according to the prior art, to proceed as shown in FIG. 2.

One introduces the fraction of high pressure air to be supercharged into a double series of passages 20-1 and 20-2, via one or two inlet boxes 28. The passages 20-1 and 20-2 are interrupted at two intermediate points, corresponding respectively to the temperatures T2 and T1, by transverse bars 29 and 30.

At temperature T2, the air leaves via a lateral box 31, and is introduced into only the passages 20-1 via a lateral box 32, the boxes 31 and 32 being situated on opposite sides of the bar 29. From this latter, the passages 20-2 are suppressed and become the passages 23. Just before the bar 30 (temperature T1), the high pressure air leaves passages 20-1 via lateral box 33, is supercharged by blower 7 and introduced into the passages 23 via a lateral box 34 adjacent the bar 29. Just before the bar 30, this supercharged air leaves via a lateral box 35 and is reintroduced just after the bar 30, via a lateral box 36, both into the passages 23-1 which prolong the passages 20-1 and into the passages 23-2 which prolong the passages 20-2 and 23.

As will be seen, the overpressure of the thermally inactive spaces requires the presence of six lateral inlet/outlet boxes 31 to 36.

Figure 3:
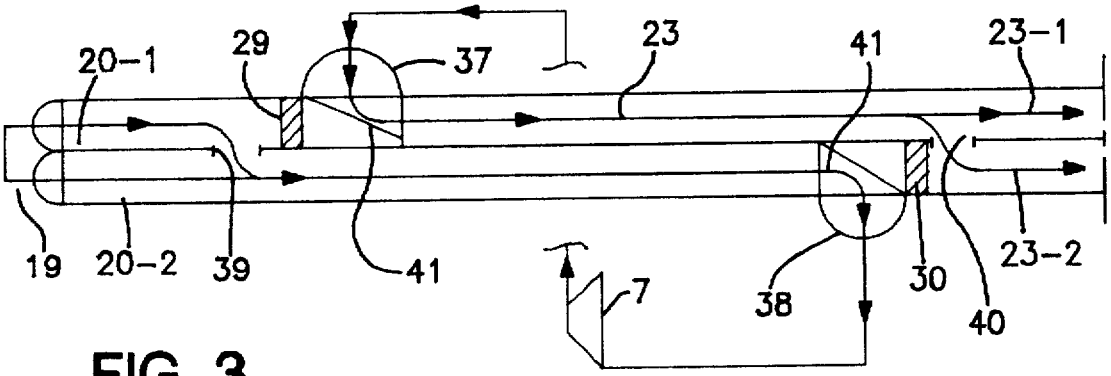
FIG. 3 shows schematically the same portion of the exchanger, but arranged according to the first embodiment of the present invention.

FIG. 3, limited to passages 20-1 and 20-2 of the exchanger, shows how, according to the invention, one arrives at the same result by utilizing only two lateral inlet/outlet boxes.

The bar 21 obstructs only the passages 20-1, while the bar 30 obstructs only the passages 20-2. The prolongation of the passages 20-1 comprises a lateral inlet window capped by a lateral inlet box 37, just after the bar 29, while the passages 20-2 comprise a lateral outlet window capped by a lateral outlet box 38 just before the bar 30. The blower 7 is connected upstream of the box 38, and downstream from the box 37. The passages 20-1 communicate with the passages 20-2 by a series of openings 39 located just before the bar 29, and the prolongation of the passages 20-1 communicates with that of the passages 20-2 by another series of openings 40 located just after the bar 30.

Comparing FIGS. 2 and 3, it will be seen that the passages 23 are passages located in the prolongation of passages 20-1, between the bars 29 and 30, and that after the bar 30 are located the passages 23-1 and 23-2 for supercharged air.

There is also schematically shown in FIG. 3 a distribution corrugation 41 associated with the box 37 and an analogous collecting corrugation 41 associated with the box 38. These corrugations have partially oblique structure well known in the art of brazed plate heat exchangers, the structure permitting distributing over all the width of the exchanger a fluid introduced laterally or even to collect toward a lateral outlet window a fluid flowing over all the width of the passage in question. Analogous distributing/ collecting corrugations are of course present in association with the inlet/outlet boxes 28 and 31 to 36 of FIG. 2.

As seen in FIG. 3, the direct communication between the passages 20-1 and 20-2 or 23-1 and 23-2 ensured by the openings 39 and 40 takes place because the passages 20-1 and 20-2 are contiguous. This has the drawback that these passages do not exchange heat with the fluids in the course of being reheated other than by one of their two surfaces.

Figure 4:
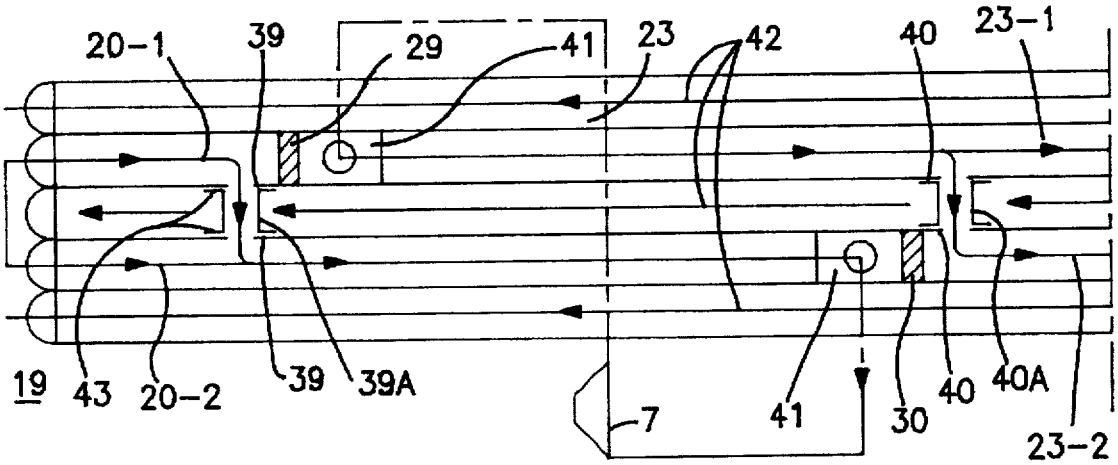
FIG. 4 is an analogous view, of one modification.

To avoid this drawback, there can be used the arrangement shown in FIG. 4, in which each passage 20-1 or 20-2 is arranged in sandwich fashion between two passages 42 in which circulates a fluid in the course of heating, from the double column 1. The placing of the passages 20-1 and 20-2 in communication, on the one hand, and 23-1 and 23-2 on the other hand, is then achieved by means of tubes 39A, 40A opening into the openings 39, 40 and provided at each end with an external collar 43 brazed about the corresponding opening.

Figure 5:
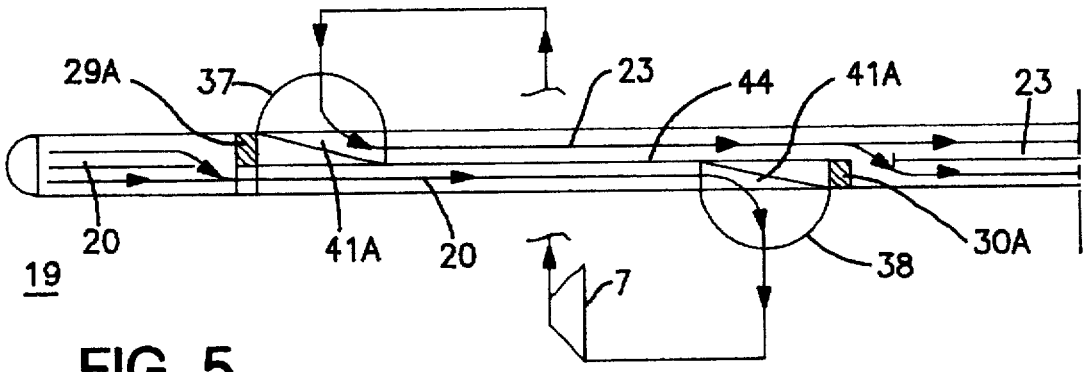
FIG. 5 is an analogous view, corresponding to the second embodiment of the invention.
Figure 6:
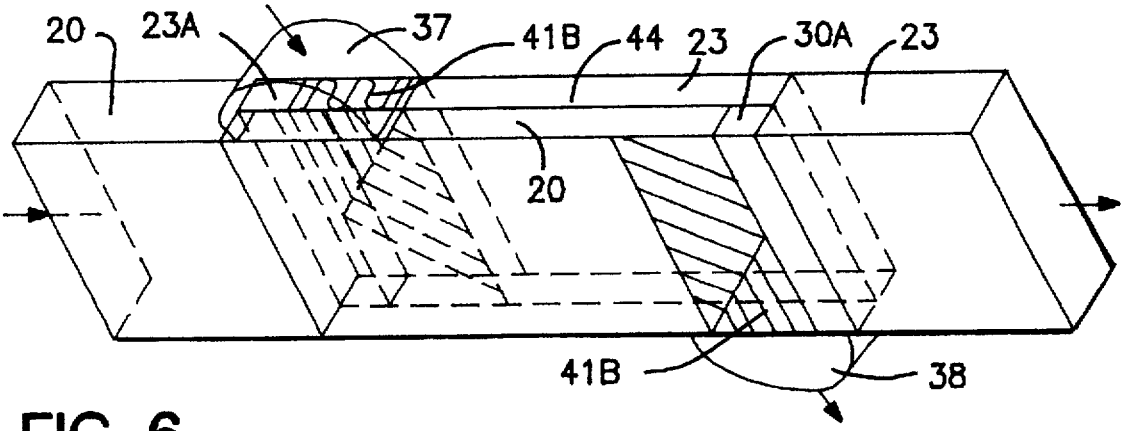
FIG. 6 is a corresponding schematic view, in perspective.

FIGS. 5 and 6 show another arrangement permitting utilizing only two lateral boxes 37 and 38 in the same application. In this case, there is only one series of passages 20. From the temperature T2 to the temperature T1, each of these passages is subdivided in its thickness into two subpassages by an intermediate plate 44. A transverse bar 29A closes only one of the subpassages at its warm end (corresponding to the temperature T2), and another transverse bar 30A closes only the other subpassage at its cold end (corresponding to the temperature T1). The first subpassage opens laterally, just after the bar 29A, through an entry window capped by the lateral inlet box 37, and the second subpassage opens laterally, just before the bar 30A, through an outlet window capped by the lateral outlet box 38. Each subpassage contains a corrugation-spacer of corresponding thickness, completed facing the box 37, 38 by a distributing, respectively collecting, corrugation 41A.

Thus, in the embodiment of FIGS. 5 and 6, the passages 20 have a thickness reduced from T2 to T1, the rest of their thickness being occupied by the passages 23. These latter have the full thickness of the passages 20 beyond the downstream bar 30A.

In the embodiment of FIG. 7, use is again made of a subdivision of the passages 20 between the temperatures T2 and T1, but this subdivision takes place across the width of these passages, by means of three successive bars which constitute together a separation wall of general S shape: a bar 45 which extends obliquely from one lateral edge of the exchanger to the middle of its width; a longitudinal bar 46; and a bar 47 parallel to the bar 45 and extending from the cold end of the bar 46 to the other lateral edge of the exchanger.

An oblique triangular corrugation 48, connected to the upstream side of the bar 45, guides the air contained in the passage 20 from a single side of the bar 46 (below this latter in the drawing), to the collection corrugation 41B associated with the lateral outlet box 38, which is located just before the bar 47. Similarly, the lateral inlet box 37 is located just after the bar 45, with its distribution corrugation 41B. The air supercharged by the blower 7 circulates first in the remaining half passage (above the bar 46 in the drawing), then is redistributed over all the length of the exchanger by a second triangular oblique corrugation 49 connected to the downstream side of the bar 47.

Figure 7:
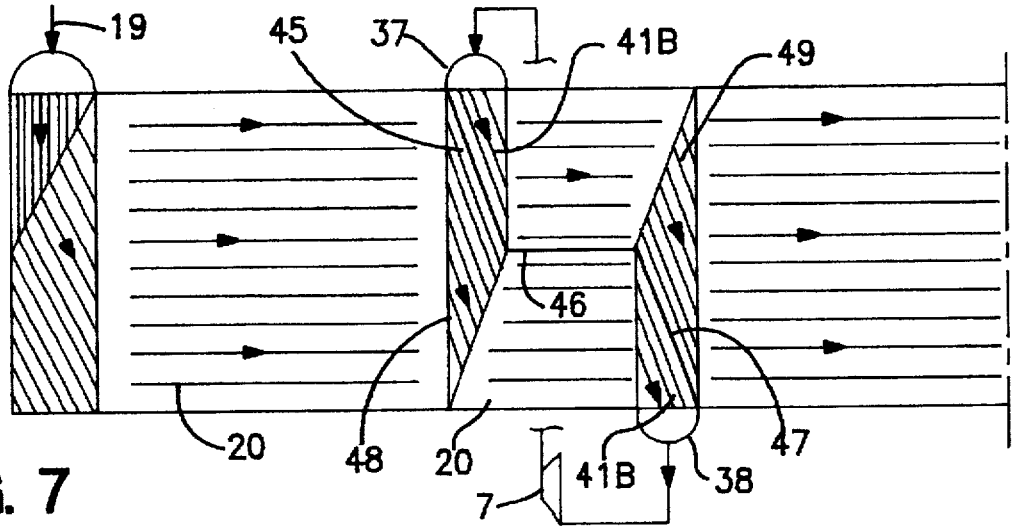
FIG. 7 shows the third embodiment of the invention.

The embodiment of FIG. 7 has, relative to that of FIGS. 5 and 6, the advantage of greater simplicity of construction, reduced cost and smaller pressure drop between the temperatures T2 and T1.

Figure 8:
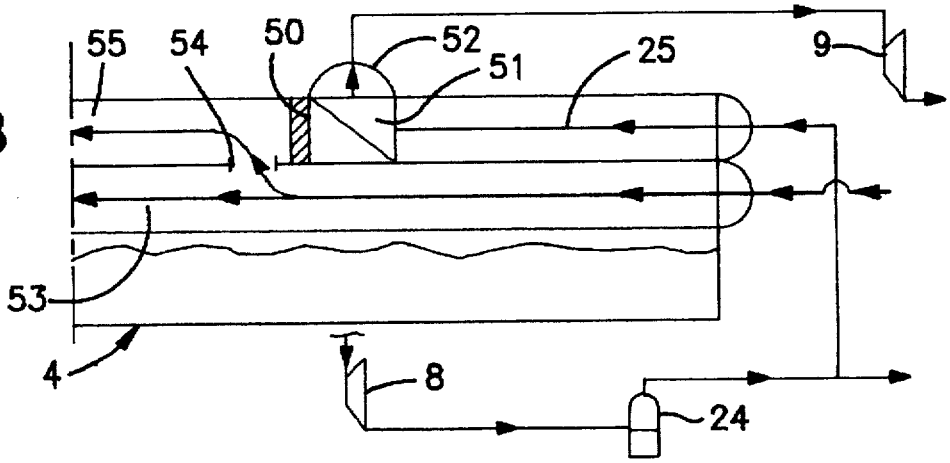
FIG. 8 is a view analogous to FIG. 3, relating to another portion of the heat exchanger.

FIG. 8 illustrates the use of the invention, in the embodiment of FIG. 3, for the reheating of medium pressure air from the turbine 8 of FIG. 1, from the cold end of the exchanger 4 to the temperature T4: the reheating passages 25 are closed at this temperature T4 by a transverse bar 50, flanked on the cold side by a collecting corrugation 51 and a lateral outlet box 52, this latter being connected to the intake of the turbine 9 of FIG. 1. Another fluid in the course of reheating, which is preferably a low pressure fluid from the double column 1, circulates in the passages 53 contiguous to the passages 25 and communicating, via openings 54 located just after the bar 50 (with regard to the flow direction of this fluid), with the prolongation 55, on the warm side, of the passages 25. The intermediate temperature outlet of the medium pressure air without creating thermally inactive spaces in the exchanger can thus be effectuated with a single lateral box 52, while three lateral boxes would be necessary with the conventional arrangement of brazed plate exchangers.

Of course, the modification of FIG. 4 and the embodiments of FIGS. 5–6 and 7 can also be used in the application of FIG. 8.

We claim:

1. Heat exchanger with brazed plates and essentially longitudinal circulation of fluids, of the type comprising a stack of parallel plates and, corrugated spacers disposed therebetween, each pair of plates defining a fluid passage of generally flat shape, wherein at least one passage (20) is subdivided along its thickness, between two intermediate positions along its length (at 29A, 30A), into two subpassages separated by an intermediate plate (44), a first subpassage being closed at a first intermediate position (at 29A) and opening freely into said passage at said second intermediate position, and the second subpassage is closed at said second intermediate position (at 30A) and opens freely into said passage at said first intermediate position.

* * * * *